United States Patent [19]

Watkins et al.

[11] Patent Number: 4,845,319

[45] Date of Patent: Jul. 4, 1989

[54] KEY SWITCH ASSEMBLY

[75] Inventors: Richard R. Watkins, Gilbert; Dale E. Brumit; Thomas R. Coey, both of Tucson, all of Ariz.

[73] Assignee: KB Denver, Inc., Colo.

[21] Appl. No.: 131,100

[22] Filed: Dec. 10, 1987

Related U.S. Application Data

[63] Continuation-in-part of Ser. No. 41,467, Apr. 23, 1987, Pat. No. 4,778,952.

[51] Int. Cl.[4] ..... H01H 3/12

[52] U.S. Cl. ..... 200/5 A; 200/292; 200/517

[58] Field of Search ..... 200/5 A, 159 B, 292

[56] References Cited

U.S. PATENT DOCUMENTS 4,398,074 8/1983 Danielson et al. ..... 200/159 B 4,582,967 4/1986 Brumit et al. .

*Primary Examiner*—A. D. Pellinen

*Assistant Examiner*—Morris Ginsburg

*Attorney, Agent, or Firm*—Gregory J. Nelson

[57] ABSTRACT

A key switch assembly for direct mounting on a PCB or similar substrate. The key switch has a body with depending mounting pin having retainers thereon to secure the key switch at apertures in the substrate. The key switch body has a hinged key and includes a snappable dome moveable from a non-actuated position to an actuated position in direct contact with conductive elements in the substrate by manual depression of a key.

5 Claims, 3 Drawing Sheets

KEY SWITCH ASSEMBLY

This is a continuation-in-part of application Ser. No. 041,467, filed Apr. 23, 1987, now U.S. Pat. No. 4,778,952, issued Oct. 18,1988.

The present invention relates to switches and more particularly to a keyboard switch assembly with tactile feedback for use in keyboards or electronic devices.

The construction of electronic calculators, keyboards and other electronic apparatus for digital control and data entry utilize snap-action, resilient contact elements in conjunction with conductive substrates such as printed circuit boards (PCB's). The substrate carries a plurality of conductive circuit paths which are selectively bridged upon depression or actuation of the conductive resilient contact elements. The contact element may be of different configurations but these elements are generally dome shaped and are disposed on the substrate with a portion of the dome being in electrical and physical contact with a portion of one conductive path. The central region of the resilient dome aligns with another conductive section on the substrate so as to enable electrical connection between the paths when the dome is actuated by application of manual pressure forcing the dome downwardly into contact with the subjacent conductive path portion. The dome shape is preferred because it exhibits tactile snap action although various other contact elements and other geometric shapes are also found in the prior art. In some applications, the contact elements may be directly actuated by the user in which case the user simply applies force with a finger or instrument to cause actuation. However, in the construction of many components such as keyboards, the use of a key switch to actuate the contact element is preferred. In addition to providing the tactile snap action of positive switching, a key switch can be provided in different sizes and shapes depending upon the design requirements and user preference.

Products such as computer data terminals and telephones utilize keyboard switch assembles in which the snapaction contact member is actuated by a key switch. Generally these assemblies are constructed with a keyboard overlying the conductive substrate. The key switches are located at predetermined locations on the board and are hingedly secured so that they are bendable or depressable to operate and engage the associated contact members. Typical U.S. Patents in the prior art showing switches of this type are U.S. Pat. Nos. 4,355,483; 4,323,740; 4,032,729; 4,128,744; 4,190,748; 4,360,722; and 4,582,967.

While key switch assemblies as generally discussed above are widely accepted in the industry and are well suited for their intended purpose, certain deficiencies and limitations are inherent in such devices. One problem arises due to the fact that such key switch assemblies are normally secured either directly to the PCB or to a smaller printed circuit member by soldering. The soldering process inherently involves the introduction of contamination to the electrical components due to the solder and to the flux used in this operation. In addition to the contamination problem, the securement of switches by conventional soldering techniques such as by wave soldering requires additional manufacturing operations. Once the switches are secured by solder, they are more difficult to remove from the board as the solder connection must be melted prior to replacement or repair.

Accordingly, it is an object of the present invention to provide an improved key switch assembly which is versatile, simple and easy to install and provide the keyboard designer great flexibility designing custom boards.

The above objects of the present invention are accomplished by a key switch assembly which attaches directly on a PCB or other similar substrate. The key switch has a body provided with one or more depending mounting pins having retainers thereon to secure the key switch at predetermined locations at apertues in the substrate. The key switch body includes a snappable dome movable from a nonactuated position to an actuated position in direct contact with conductive elements on the substrate to establish electrical connection. Soldering and contamination attendant to the soldering process is eliminated. Further, the key switch of the present invention is easily mountable and removable from the substrate.

Accordingly, it is an important object of the present invention to provide an improved key switch assembly providing snap action with tactile feedback which is attachable to a substrate without the necessity of soldering operations.

A further object of the present invention is to provide an improved keyboard assembly and key switch mechanism which is economical to produce and is reliable in operation.

Still another object of the present invention is to provide a key switch assembly which provides positive actuation of the conductive element or dome.

Still another object of the present invention is to provide a keyboard assembly and keyboard switch mechanism which is detachably securable to the substrate at mounting pins and which switch provides substantial flexibility to the designer.

Other object and advantages of the present invention will be apparent to and understood by those skilled in the art from the following detailed description and drawings in which.

Figure 1:
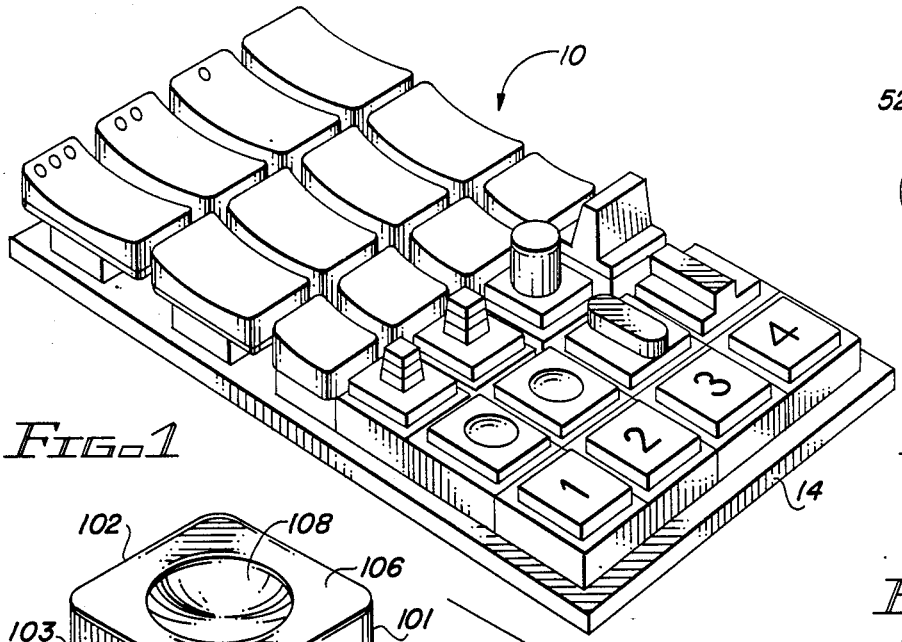
FIG. 1 is a perspective view of a portion of a keyboard assembly incorporating the key switch actuator.
Figure 2:
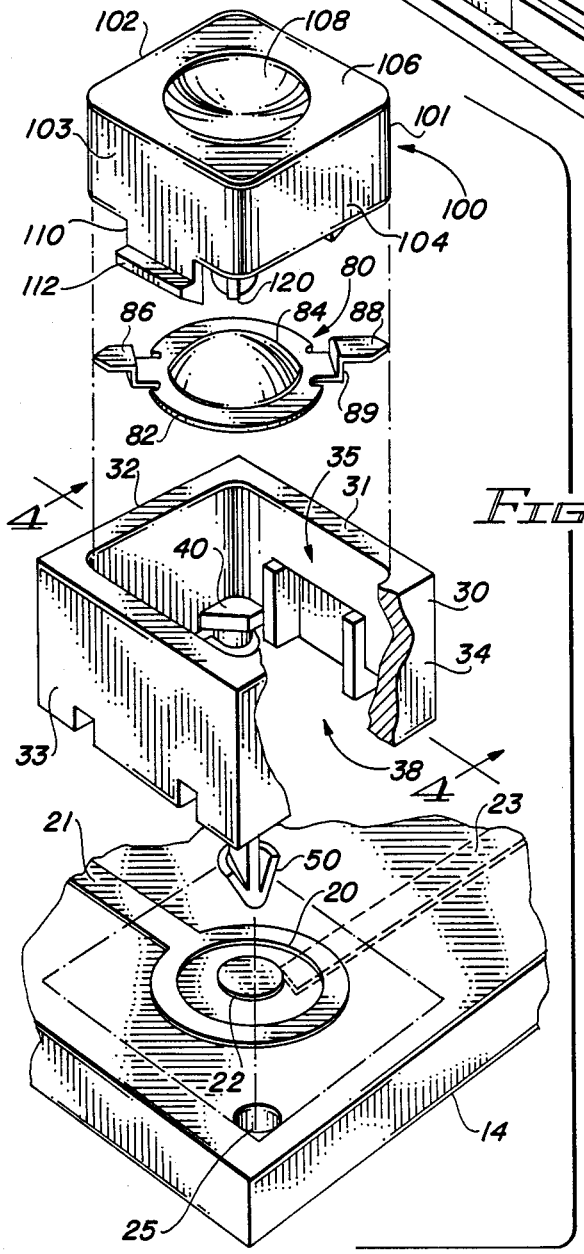
FIG. 2 is an exploded view illustrating a portion of the substrate and the key switch assembly.
Figure 4:
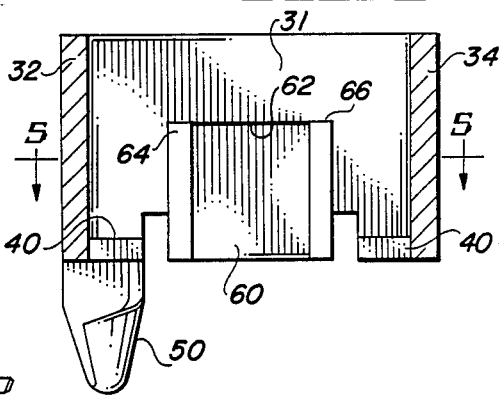
FIG. 4 is a sectional view taken along line 4—4 of FIG. 2.
Figure 5:
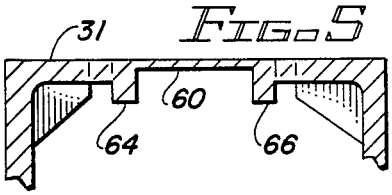
FIG. 5 is a partial sectional view taken along line 5—5 of FIG. 4.

Turning now to the drawings, FIGS. 1 to 6 show a keyboard generally designated by the numeral 10. Keyboard 10 is of the type commonly utilized in connection with computer terminals and other similar electronic equipment. Keyboard 10 consists of a housing, not shown, within which is a substrate 14 such as a PCB containing appropriate conductive artwork. Typical artwork is shown in FIG. 2 and include a generally circular or arcuate section 20 connected to electrical pathway 21. Contact element 22 is centrally disposed within arcuate portion 20 and electrical pathway 23 extends from contact element 22. Snappable domes are generally mounted directly on the substrate 14 with the periphery of the dome resting or in contact with arcuate or peripheral contact element 20. When the dome is depressed, the central region of the dome is placed in contact with contact element 22.

With the present invention, substrate 14 is fabricated having one or more mounting holes or apertures 25 disposed adjacent the conductive artwork. Apertures 25 extend through the substrate and are adapted to directly mount key switch housing 30 on the upper surface of the substrate. The key switch housing 30 is formed of a suitable non-conductive material such as ABS or the like.

Figure 3:
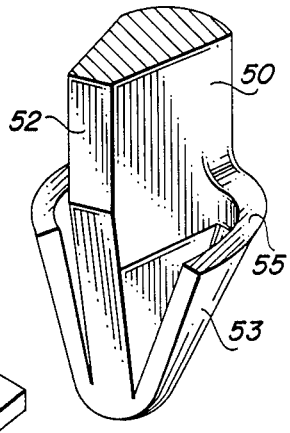
FIG. 3 is an enlarged detail view of the key switch mounting pad.

Housing 30 is shown having side walls 31, 32, 33 and 34 forming a rectangular enclosure having an open upper end 35 and an open lower end 38. A rest or platform 40 extends diagonally at the lower end of walls 31 and 32. Similarly, a rest or platform 42 extends at the lower end of walls 33 and 34 diagonally opposite rest 40. A retainer pin 50 depends from the underside of platforms 40 and 42. Pins 50 are adapted to align with apertures 25. As seen in FIG. 3, each of the pins 50 includes an elongate body 52 terminating at a head 53. Head 53 is generally conical having outwardly extending wings or flukes 55 which are flexible. The flukes or wings 55 will collapse when they are forced through the associated aperture 25 and upon emerging at the underside of the substrate 14 will expand to the position shown in FIG. 3 securing the body 30 in place on the substrate.

Opposite side walls 33 and 31 are each provided with a recess 60. Recess 60 extends vertically in a central location intercepting the bottom edge of the side wall and terminating at an intermediate location at horizontal shoulder 62. Vertically extending guide members 64 and 66 are provided adjacent the side of recess 60. As will be explained hereafter, the hinge of the key switch 100 is engageable in the recess 60 in an assembled position.

Figure 6:
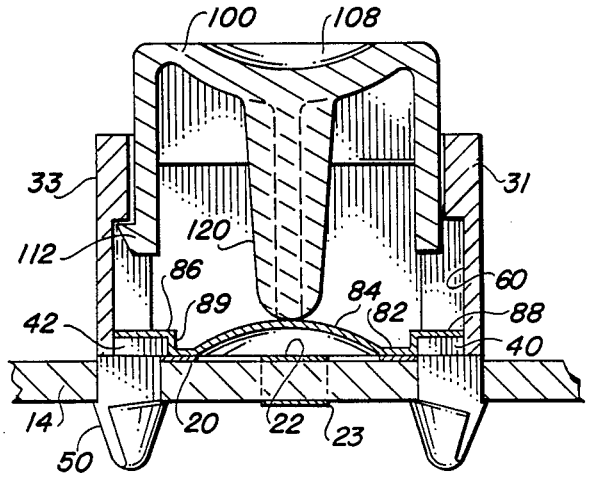
FIG. 6 is a sectional view of the assembled keyboard switch.

Contact member 80 is generally hemispherical having a peripheral edge portion 82 and an elevated dome portion 84. The contact member 80 is formed of metal or other conductive material and the peripheral edge 82 of the member generally corresponds to conductive path 20. Mounting tabs 86 and 88 extend oppositely from the dome 80 and are vertically offset at shoulder 89. The mounting tabs 86 and 88 are adapted to rest on platforms 40 and 42. As best seen in FIG. 6, the offset at shoulder 89 permits the contact in the assembled position to assume a position with peripheral edge 82 of the contact element 80 resting on conductive path 20. In the assembled position dome 84 is elevated above contact element 22 on the substrate 14.

The contact 80 is actuated or depressed by means of key cap 100. The key cap is an integral or one-piece assembly preferably molded from a suitable non-conductive plastic material such as ABS and may be made by injection molding or other well-known fabrication techniques. The key cap is rectangular with side walls 101, 102, 103 and 104 which closely conform to the interior of body 30 permitting the key switch movement. The upper surface 106 of the cap defines a recess or depression 108 to receive the tip of the finger of the user to facilitate manual actuation of the key switch member. A striker pin 120 extends vertically from the underside of the surface 106 and is aligned and dimensioned to contact the center portion dome 84 in the assembled, non-actuated position as best shown in FIG. 6.

Figure 7:
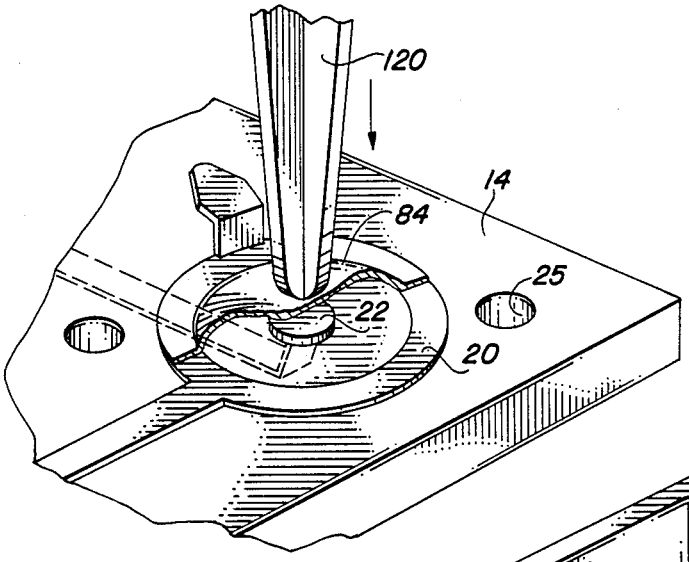
FIG. 7 is a detail view of the actuator pin and snappable dome with certain elements eliminated for clarity.

The key cap is mounted to body 30 by means of a hinge 110 which depends from side 103. The lower edge of hinge 110 is provided with a transversely extending flange 112 which is engageable at shoulder 62 as best seen in FIG. 6. Switch closure is accomplished by exerting a manual downward force on the upper surface of the cap at 108 which causes the switch to pivot downwardly about the hinge 110 as seen in FIG. 7. The downward pivoting movement of the switch will depress the dome portion 84 through the elongated striker bar or pin 120 which, in turn, brings a portion of the dome 84 into contact with element 22 on the substrate establishing electrical connection.

In use, the operator applies manual force to the key switch by means of downward pressure with the tip of the finger at depression 108 on the key cap. When pressure is applied, the key cap pivots downwardly about the hinge point applying force to the dome switch by means of the actuator or striker pin. Thus, positive and tactile actuation is achieved through the use of the key switch.

As pointed out above, the key switch may be easily assembled on the PCB without the necessity of soldering operations. The switch is quickly and conveniently secured to the board by simply inserting the retainer pins 50 in the appropriate apertures 25 provided in the substrate. The expandable head 53 associated with the retainer pins will expand to securely position the key switch in place. If it is desired to remove the key switch, the outwardly expandable retaining wings 55 may be manually collapsed to allow them to be withdrawn upwardly through the apertures in the substrate. The key switch body 30 is preferably configured as shown in FIG. 2 with a mounting recess 60 provided in opposite side walls so that the hinge may be located at either wall for convenience of assembly. It is, of course, within the scope of the invention to provide hinged mountings at any of the interior side walls so that the assembler could orient the hinge connection at the interior of any of the four side walls.

Unitary assembly of the present invention reduces the cost of manufacturing and increases reliability. Because each key switch assembly is independent, custom design of keyboards is facilitated giving the electronics designer great flexibility. Further, maintenance is easy in that if a problem exists with a single key switch, one only need remove and replace the particular key switch which is determined as being a problem. Key caps can be individualized and identified by appropriate indicia or color and provided in different sizes and shapes, as shown in FIG. 1.

Figure 8:
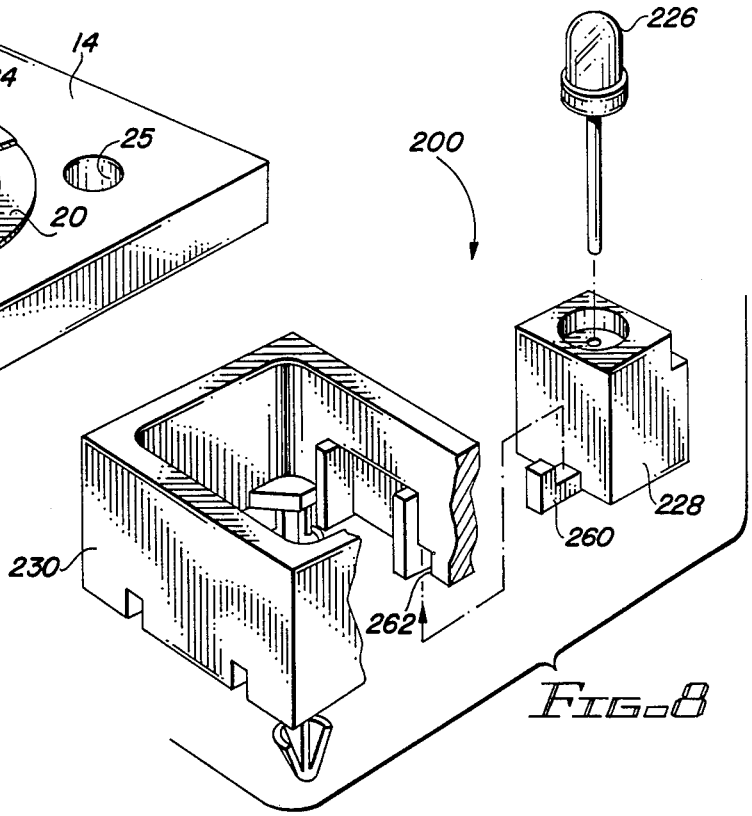
FIG. 8 is an exploded view of an alternate embodiment of the present invention.
Figure 9:
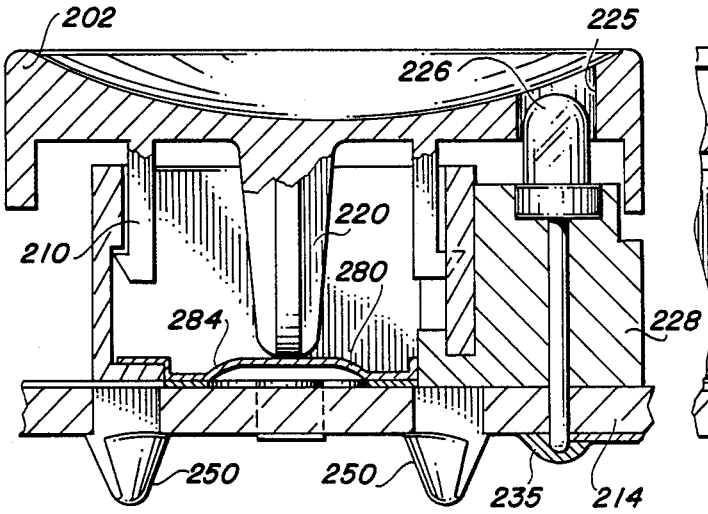
FIGS. 9 and 10 are sectional view of an alternate embodiment of the keyboard switch assembly of FIG. 8 showing, respectively, the non-actuated and actuated positions.
Figure 10:
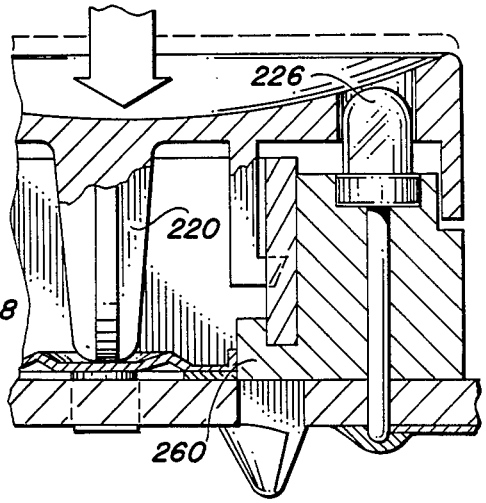

FIGS. 8 to 10 show an alternate embodiment of the present invention which is generally designated by the numeral 200. Key switch assembly 200 includes a body member 230 secured to a substrate 214 by depending retainer pins 250. A key cap 202 is pivotally mounted within the body at hinge 210. Depending actuator pin 220 serves to depress the dome 284 of hemispherical contact member 280. In regard to the features described above, they are generally identical or similar to those set forth with reference to FIGS. 1 to 3 and, therefore, further detailed description is not believed necessary.

In embodiment 200, key cap 202 is enlarged extending laterally beyond the sides of body 230. The upper surface of the key cap is shown as having a generally arcuate configuration. A peripheral edge of the key cap defines an aperture 225 which receives LED 226. LED 226 is secured to LED holder 228 mounted adjacent the key switch body. LED 226 is connected to contact point 235 on substrate 214. The LED holder may be formed as an integral part of body 230 or may be a separable component secured at notch 262 by locking tab 260.

In assembly, the key switch of this embodiment, the LED holder 228 containing LED 226, if first secured to the board 214 at contact 235. Thereafter, the key switch body is secured in place in the appropriate apertures in the board and the key switch engaged to the body in a pivotal position.

Figure 11:
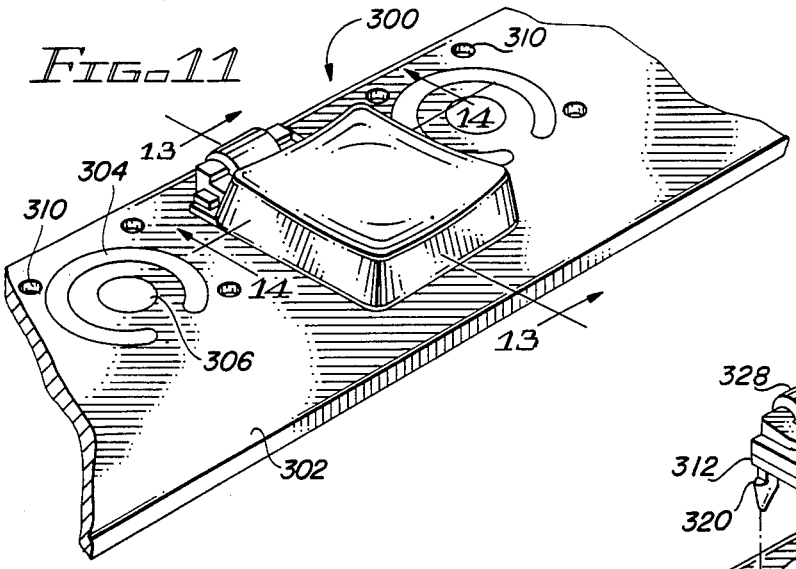
FIG. 11 is a perspective view of another embodiment of the present invention.
Figure 12:
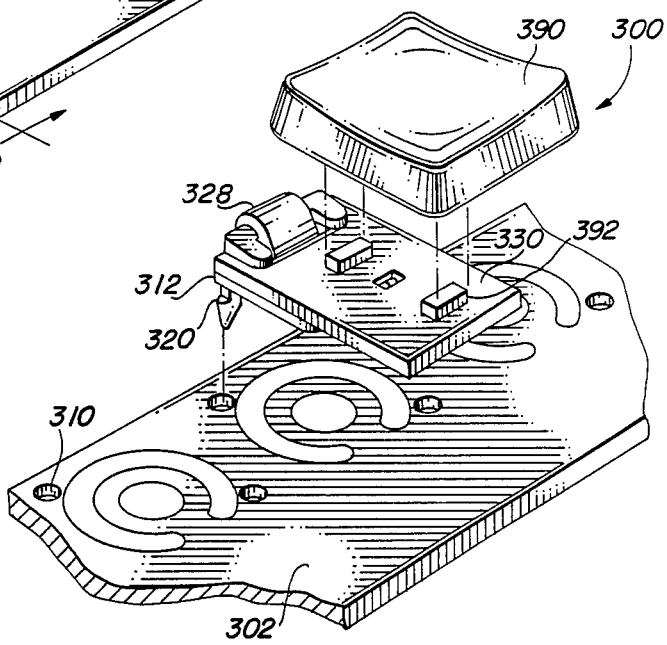
FIG. 12 is an exploded view of the embodiment shown in FIG. 11.
Figure 15:
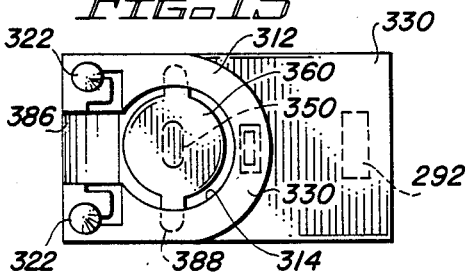
FIG. 15 is a bottom view of the key switch of FIG. 11.
Figure 16:
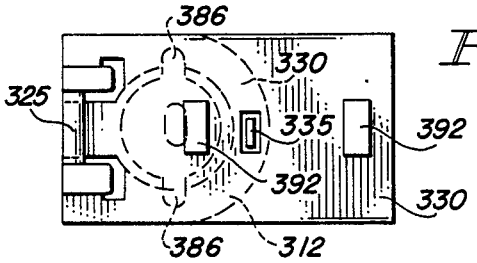
FIG. 16 is a top view of the key switch with the key cap removed for clarity.
Figure 17:
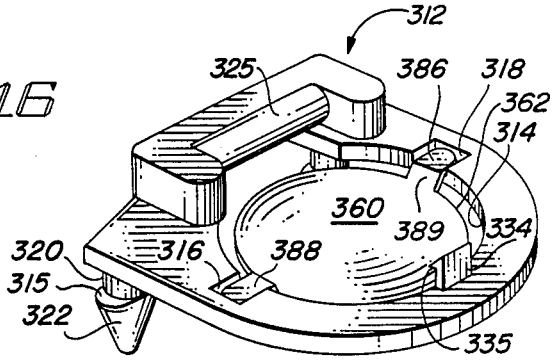
FIG. 17 is a perspective view of the key switch base and dome.

FIGS. 11 to 17 show still another embodiment of the present invention which is generally designated by the number 300. The key switch assembly 300 is shown in conjunction with the substrate 302 having conductive artwork thereon which includes a generally circular or annular section 304, connected to an electrical pathway. Contact element 306 is centrally disposed within annular portion 304 and is also connected to an appropriate conductive pathway. One or more mounting holes 310 are provided in substrate 302 adjacent the conductive artwork. Holes 310 extend through the substrate 302 and are adapted to directly mount the key switch 300 on the upper surface of the substrate adjacent the artwork as best seen in FIGS. 11 and 12.

The key switch 300 includes a base member 312 which defines a generally circular opening or aperture 314. Diametrically opposed notches 316 and 318 are provided at aperture 314. One or more retainer pins 320 depend from the underside of base 312 and are adapted to align with apertures 310 in the substrate. Each of the pins 320 has an elongate body terminating at a head 315 which is generally conical having one or more outwardly extending wings or retainers 322. The retainers are deformable so that they may be forced through the holes 310 and upon emerging at the underside of the substrate 302 will expand to the position shown in FIGS. 13 and 14 securing the key switch base in place on the substrate.

Figure 13:
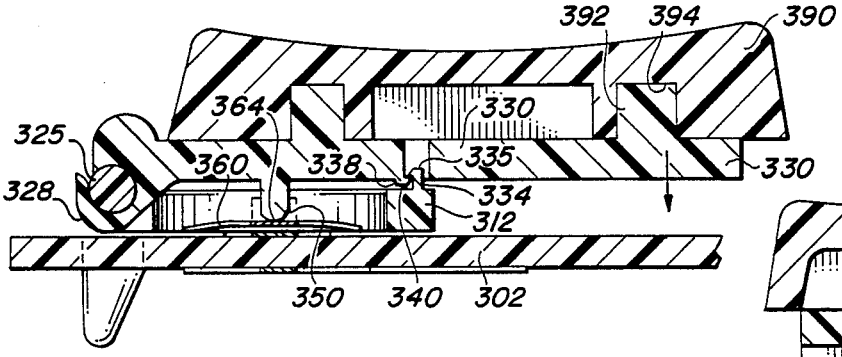
FIG. 13 is a sectional view taken along line 13—13 of FIG. 11.

The rear portion of the base is provided with a transversely extending hinge pin 325 which is cooperative with generally U-shaped flange 328 on the key 330. Key 330 is generally rectangular having a longitudinal dimension exceeding the length of the base 312 as best seen in FIG. 13. The U-shaped flange 328 may be engaged on the hinge pin 325 and when key 330 is positioned generally parallel to the body as shown in FIG. 13, the key is permitted limited rotational movement about the hinge pin. In order to retain the key in the position shown in FIG. 12, the underside of the key cap is provided with a latch member 338 and including a forwardly extending hook 340. Similarly, the upper surface of base 312 is also provided with a latch member 334 having a rearwardly extending hook member 335. The hook members are of resilient material and when the unit is assembled, the key cap is pushed downwardly so that the hook members are engaged permitting limited relative movement of the key relative to the base.

Figure 14:
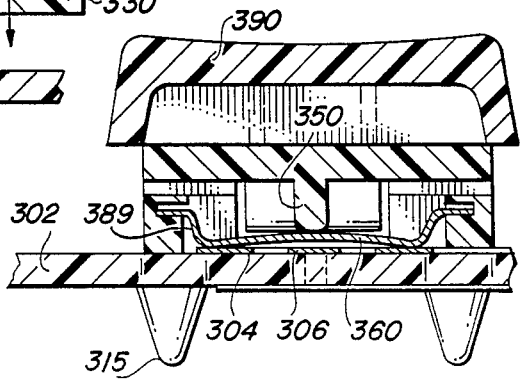
FIG. 14 is a sectional view taken along line 14—14 of FIG. 11.

The underside of the key 330 is provided with a downwardly extending striker 350 which is generally aligned with the center of the circular opening defined by base 312. Circular opening 314 receives contact dome 360 which is generally hemispherical having a peripheral edge portion 362 and an elevated central portion 364. The contact dome is formed of metal or other conductive material and the peripheral edge 362 of the member generally corresponds to the conductive path 304. Mounting tabs 386 and 388 extend oppositely from the dome and are each vertically offset at shoulder 389. The mounting tabs 386 and 388 are adapted to be received in the opposed recesses 316 and 318. As best seen in FIGS. 13 and 14, the offset at shoulder 389 permits the dome 360 in the assembled position to assume a position with the peripheral edge 362 of the dome resting on the conductive path 304. The center 364 of the dome is elevated above the central contact element 306 on the substrate. When the key switch is moved to the actuated position, the center of the dome is moved downward to establish contact between the conductive paths 304 and 306.

A key cap 390 may be engaged with the key by frictional engagement of the upwardly extending projections 392 in appropriate recesses 394 in the underside of the key cap. The key cap may be molded from any suitable non-conductive plastic material. Similarly, the key and base of the switch may also be molded from a suitable non-conductive material such as ABS such as by injection molding or other well-known plastic fabrication techniques. Key cap 390 may be conveniently made in any desired size and color in accordance with the requirements of the user. The upper surface of the cap may be curved to receive the tip of the finger of the user to facilitate manual actuation of the key switch.

As pointed out above, the key switch may be easily assembled on the substrate without the necessity of a soldering operation. The switch is conveniently assembled by placing dome 360 within the base and engaging the key 330 at the hinge members 328 and 325 and rotating the key to a position so that the latch members 335 and 340 engage. The appropriate key cap 390 may be selected and engaged on the key. The switch is then ready for quick and convenient mounting on the substrate by simply inserting the retainer pins 320 in the appropriate apertures 310 provided in the substrate adjacent the conductive artwork paths. The expandable head 322 associated with the retainer pins will expand when forced through the apertures to securely position the key in place.

Thus, manufacture, assembly, and maintenance is made easier. Because each key switch assembly is independent, custom design of keyboards is facilitated giving the electronics designer greater flexibility. Key caps can be individualized and identified by appropriate indicia or color as desired.

The present invention has been described with reference to several specific embodiments thereof for the purpose of illustrating the manner in which the invention may be used. It will be appreciated by those skilled in the art that the invention is not limited to these specific embodiments. Accordingly, any and all modifications, variations or equivalent arrangements which may occur to those skilled in the art should be considered within the spirit and scope of the invention and the appended claims.

We claim:

1. A key switch actuator for use with keyboard assemblies including a substrate, said substrate having opposite first and second surfaces with aperture means therein at predetermined locations and said substrate having first and second conductive paths on said first surface, said key switch actuator comprising:

(a) a base member defining an opening therein with positioning means associated therewith, said base member further including projection means extending therefrom engageable at said aperture means to secure said base member to said substrate;

(b) contact means having a peripheral and a central portion and further having oppositely extending tabs received in said positioning means for positioning said contact means in said base member in a normally non-actuated position with said peripheral portion of said contact means in electrical contact with said first conductive path and with the said central portion of said contact means being out of electrical contact with said second conductive path;

(c) key means hingedly secured to said base member and having a first non-actuated position and a second actuated position, said key means including depending striker means cooperable with said contact means to move said contact means into electrical contact with said second conductive path in said actuated position; and (d) key cap means detachably secured to said key means and wherein said key means and key cap means are in cantilever relationship with said base member.

2. The key switch actuator of claim 1 wherein said projection means include expandable wing members expandable to engage one of said surfaces of said substrate to detachably secure said key switch actuator to said substrate.

3. The key switch actuator of claim 1 further including cooperable latch means on said base member and on said key means, said latch means for retaining said key means in a position generally parallel to said substrate permitting limited pivotal movement thereof.

4. The key switch actuator of claim 1 wherein said base member and key means are formed of non-conductive plastic.

5. The key switch actuator of claim 1 wherein said base member defines a generally circular opening and said contact means comprises a snappable dome receivable in said circular opening.

* * * * *